US005482060A

United States Patent [19]

Barradas

[11] Patent Number: 5,482,060

[45] Date of Patent: Jan. 9, 1996

[54] HAIR CURLER ROLLER

[76] Inventor: George Barradas, 15 River View Ct., Greenwich, Conn. 06831

[21] Appl. No.: 296,429

[22] Filed: Aug. 26, 1994

[51] Int. Cl.[6] ..... A45D 2/12

[52] U.S. Cl. ..... 132/226; 132/245; 132/272

[58] Field of Search ..... 132/228, 227, 132/226, 233, 245, 251

[56] References Cited

U.S. PATENT DOCUMENTS

| | | | |
|---|---|---|---|
| 2,994,327 | 8/1961 | Otto et al. | 132/245 |
| 3,316,920 | 5/1967 | Cruise | 132/245 |
| 4,881,559 | 11/1989 | Kin | 132/226 |
| 5,286,949 | 2/1994 | Simons | 132/226 X |

FOREIGN PATENT DOCUMENTS

| | | | |
|---|---|---|---|
| 1457375 | 3/1969 | Germany | 132/245 |
| 519056 | 3/1940 | United Kingdom | 132/227 |

*Primary Examiner*—John G. Weiss
*Attorney, Agent, or Firm*—Alfred E. Miller

[57] ABSTRACT

A hair curler roller and apparatus for generating steam for heating the hair curler roller. The roller is a foam with a solid backing. The foam has a foraminous construction created by abrading the outer surface of the roller cover so that the steam entering through the exterior surface of the roller cover is maintained within the roller cover for a period of time before exiting out into the hair strands wound on the roller cover. A housing for the hair curler rollers is provided with a misting device so that the rollers are misted externally and the housing is provided with a plurality of separate misting chambers.

11 Claims, 7 Drawing Sheets

HAIR CURLER ROLLER

The present invention relates to a hair curler roller that can be heated by mist or in the alternative inserted on a heating post for heating the roller in a dry condition. The roller is provided with an outer sleeve having a foam like body with a membrane backing to improve the retention of heat and mist during hair curling.

BACKGROUND OF THE INVENTION

In hair curler roller constructions of the prior art steam is generated and passes through a foam covering sleeve which permits penetration on both the front and rear surfaces of the hair curler roller. However, since the foam material has a multitude of openings through the entire material the steam, if generated through a hollow core having holes or slots therein, will pass quickly through the open material and the steam heat will dissipate to the atmosphere. This occurs since the heat will not be maintained for a considerable period of time within the roller cover before radiating outwardly during and after the hair strands are being wound around the roller cover. Such an arrangement is found, for example, in U.S. Pat. No. 4,453,554 issued on Jun. 12, 1984.

In the past a group of heated hair curler rollers have been mounted in a housing having a single cover for the entire group of rollers so that when the cover was opened all the hair curlers were subject to cooling down, and a good part of the heat was dissipated even if it was possible to rapidly place all the curlers on the hair during the hair curling process. Such a drawback is evident in FIG. 8 of U.S. Pat. No. 4,627,452 issued on Dec. 9, 1986, and also shown in U.S. Pat. No. 4,658,114 issued on Apr. 14, 1987.

SUMMARY OF THE INVENTION

It is an object of the present invention to provide a roller cover sleeve of a soft foam material perforated with or without a plurality of through holes in which the outer surface upon which the hair strands are wound around is abraded to form a foraminous outer surface permitting penetration of steam generated by the heating device through the outer surface, while the inner surface of the roller cover is non-permeable whereby the heat and moisture is absorbed and maintained within the roller cover for a longer period of time than heretofore.

Another feature of the present invention is to provide a container or housing for hair curler rollers having a heating device and a receptacle for water or hair conditioner that can be heated thereby forming a vapor mist circulated around the outside of the hair curler rollers, said mist upon condensation returning as a liquid to the container.

A further object of the present invention is to provide a container with heating posts so that the hair curler rollers which are placed on the heating posts can be heated internally while the mist heats the roller cover sleeve externally.

Another object of the present invention is to provide a hair curler roller which is provided with a perforated hollow aluminum cylinder interfitted in a perforated plastic cylinder, both of which are heated by vapor mist moving through the center of said aluminum cylinder and through the perforations to permeate the roller cover sleeve.

Another feature of the present invention is the provision of a hair curler roller having a foraminous outer cover sleeve whereby said heater generates mist which heats the outer cover of the hair curler roller and the roller is provided with an insulating cylinder within the hair curler roller whereby a pull-up hair retaining clip is provided for holding hair strands on the hair curler roller.

Another object of the present invention is to provide a receptacle or container for heating and storing a plurality of hair curler rollers in which a small number of rollers are confined in a each of a series of chambers whereby each of the chambers can be opened and closed separately without opening any of the other chambers.

A further object of the present invention is to provide a hot vapor mist which can be a mixture of water and hair conditioner, as well as hair conditioner alone, that is absorbed and spreads along the exterior foam surface of the roller sleeve cover.

Another feature of the present invention is the method of preparing a roller sleeve cover of the foam material having a membrane on the top and bottom of surfaces of the sleeve in which the top surface of the membrane is abraded in order to remove the membrane and expose a foam-like surface while the membrane on the bottom surface remains intact.

BRIEF DESCRIPTION OF THE DRAWINGS

In order that the invention may be clearly understood, it will now be disclosed in greater detail with reference to the accompanying drawings, in which.

IN THE DESCRIPTION OF THE PREFERRED EMBODIMENTS

Figure 1:
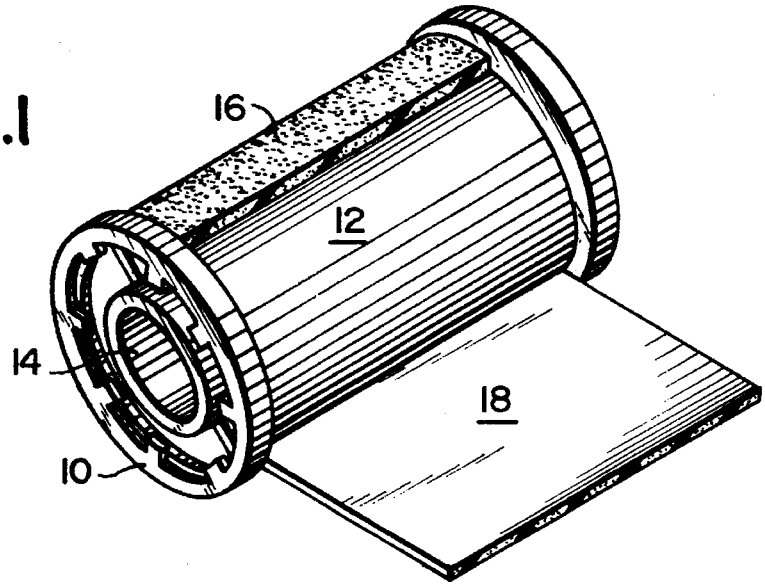
FIG. 1 is a perspective view of a hair curler roller constructed in accordance with the teachings of the present invention in which part of the roller sleeve is taken of the roller thus exposing a part of the roller body.
Figure 2:
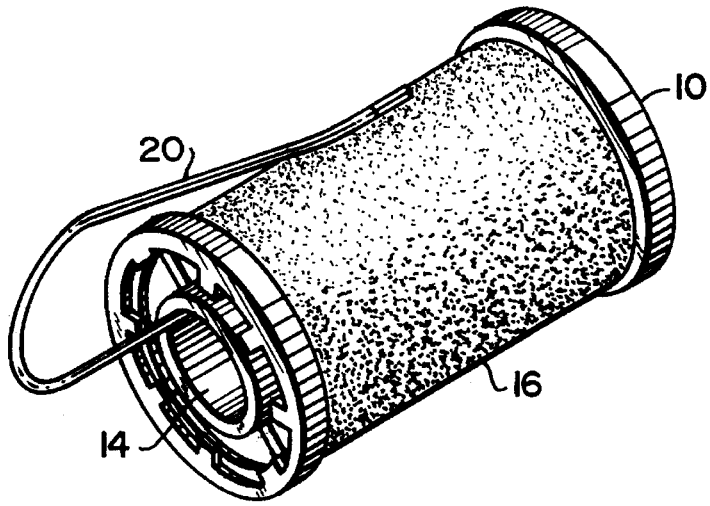
FIG. 2 is a perspective view of an assembled hair curler roller as seen in FIG. 1 together with the hair retaining clip.
Figure 3:
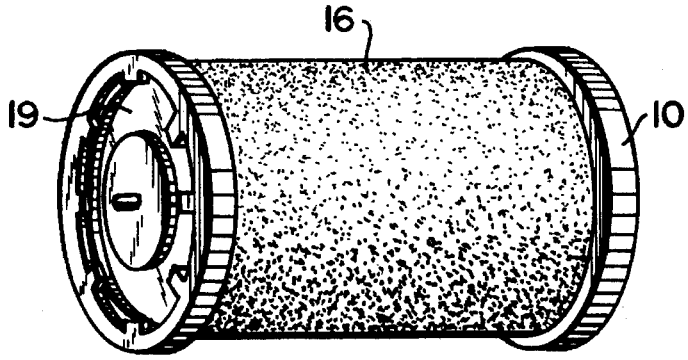
FIG. 3 is a perspective view of the opposite end of the hair curler roller.
Figure 11:
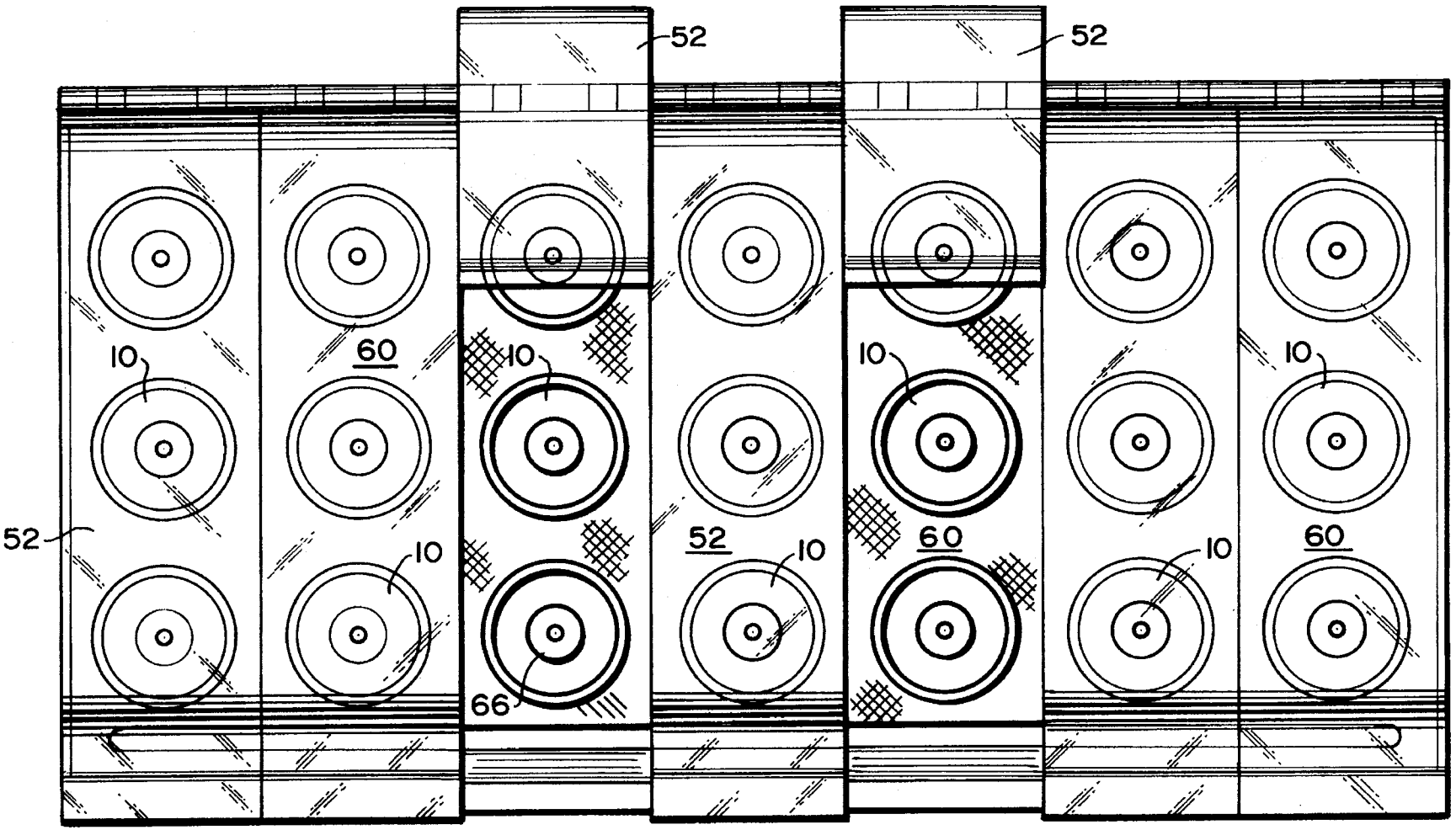
FIG. 11 is a top plan view of the receptacle or housing shown in FIG. 10.

FIGS. 1–3 show the hair curler roller 10 of the present invention having a roller body 12 provided with a central axial opening 14 which may be placed upon a heating post, as seen in FIG. 11 for additional heating. However, the principal heating of the roller 10 is by way of mist directed externally to the roller sleeve 16. The sleeve is preferably of a polyurethane foam material having a membrane or covering 18 on the inner surface of the sleeve 16. The other end 19 of the roller, as seen in FIG. 3 is closed. The roller body 12 itself is of the type generally known in the art. In addition, as seen in FIG. 2, hair retaining clip 20 can be utilized after hair strands are wound around the sleeve 16 in order to maintain the roller in place on the head of the user.

Figure 4:
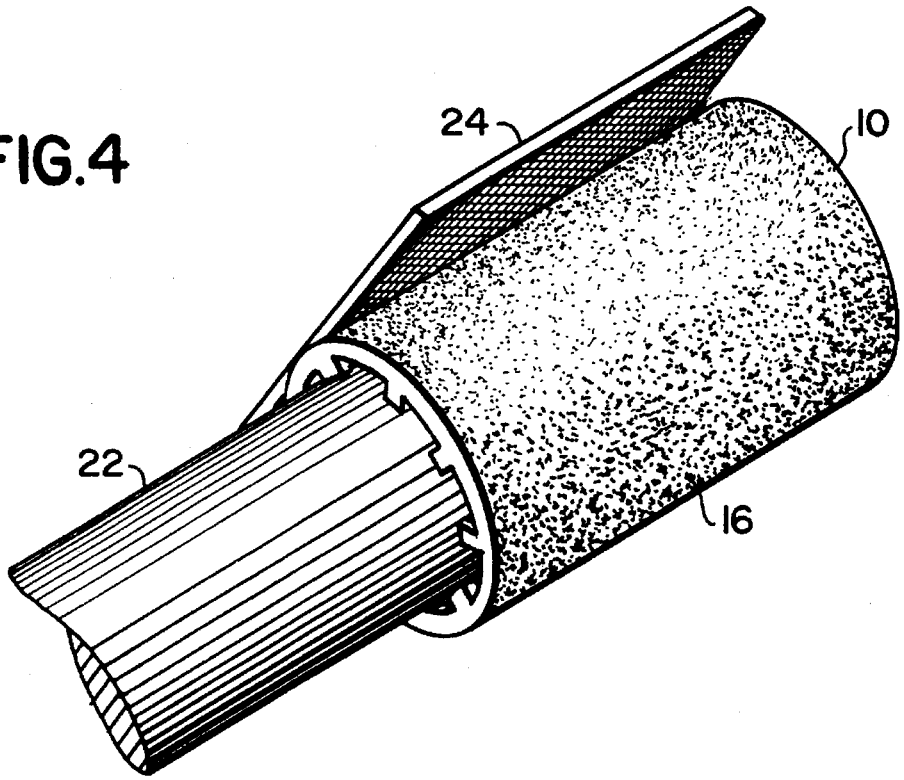
FIG. 4 is a perspective view of the method of abrading or grinding the outer surface of the hair curler roller to remove the membrane.
Figure 5:
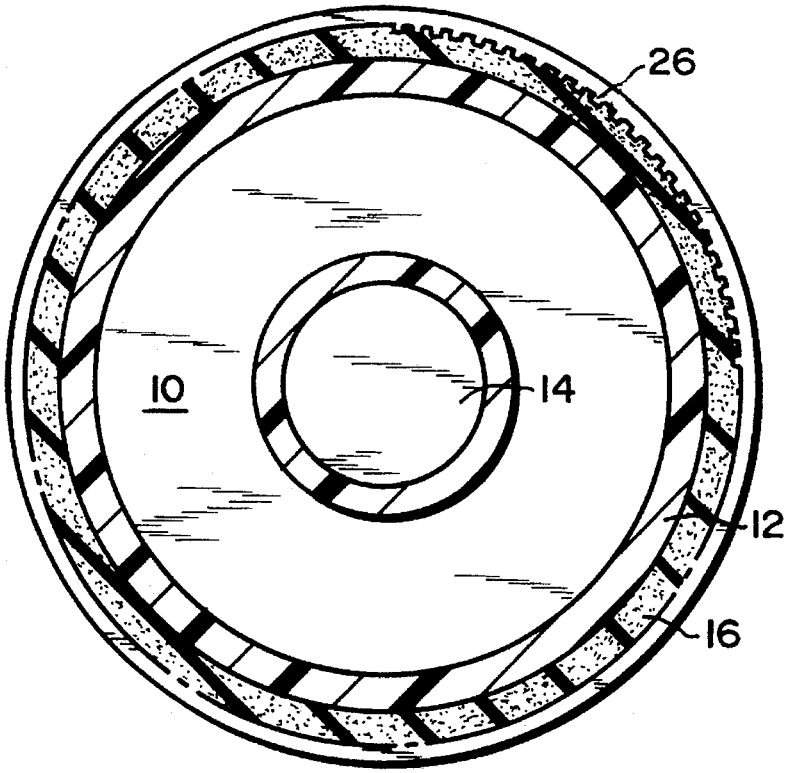
FIG. 5 is an enlarged end elevation view showing the finished outer surface of the hair curler roller after the method of FIG. 4 is completed.

Referring to FIGS. 4 and 5 where it is shown that initially sleeve 16 is provided with a membrane 18 on both the inside and outside of surfaces of the sleeve. But, as shown in FIG. 4, a core having the sleeve 16 thereon is placed upon a mandrel 22, and an abrasive plate 24 is placed against the outer surface of the sleeve in order to abrade or grind the outer membrane and remove the same thereby exposing a foraminous undersurface as the hair curler roller rotates on the mandrel 22. The foam-like foraminous surface shows short passages 26 created inwardly from the exterior surface of the sleeve, as seen more clearly in FIG. 5. Thus, the abrading of the membrane on the outer surface of the polyurethane foam sleeve creates a soft friction surface having openings therein so that when the rollers are misted ensuing liquid spreads or is absorbed on the outer surface of the sleeve similar to the action of a blotter when liquid is placed thereon. Consequently, the misting vapor penetrates into the interior of the outer sleeve and spreads laterally throughout the sleeve to increase the hot misting action on the hair strands when the hair is wound around a roller. It should be apparent that the misting vapor does not pass entirely through the sleeve to the roller body since the membrane 18 on the inside of the sleeve prevents passage of the vapor or liquid through the inside of the sleeve. Thus, there is no heat loss to the roller body and the misting vapor projects outwardly through the external surface of the sleeve and onto the hair strands for effective hair treatment. After the abrading or grinding step disclosed above, the core 14 of the sleeve 16 is removed, and the sleeve is assembled on the roller body 12.

Figure 6:
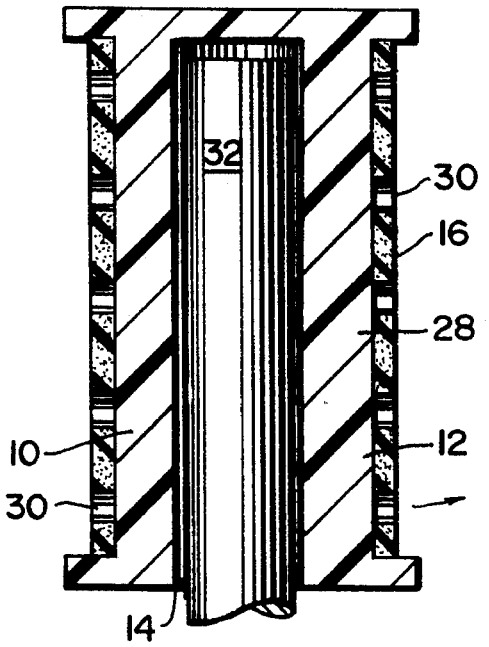
FIG. 6 is a sectional view of a hair curler roller mounted on a heating post.

FIG. 6 shows an embodiment of the present invention in which a hair curler roller 10 is placed upon a heating core to provide additional heat to the sleeve 16. However, the plastic core 28 of roller 10 transmits heat from the heating post to the roller body sleeve 16. The heat then penetrates through the die cut holes 30 in the sleeve 16 in order to heat the latter. The use of a heating post is optional and is not necessary in order to fulfill the objectives of the present invention, and can be used in conjunction with the misting arrangement or by itself.

Figure 7:
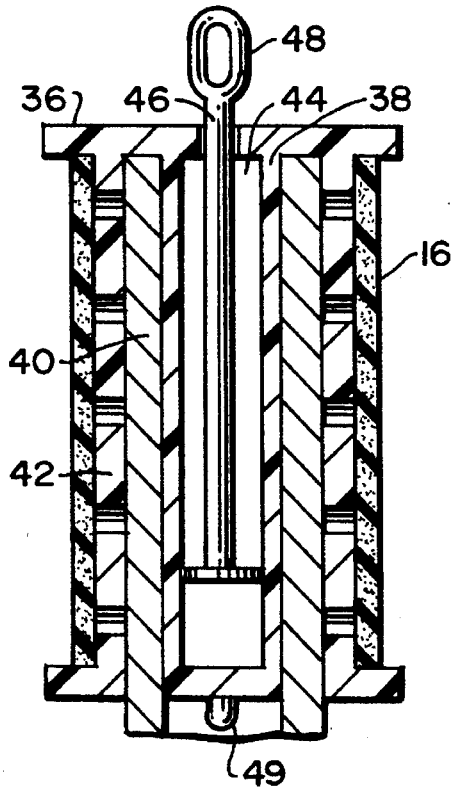
FIG. 7 is a sectional view of an alternate embodiment of the hair curler roller shown in FIG. 6.
Figure 8:
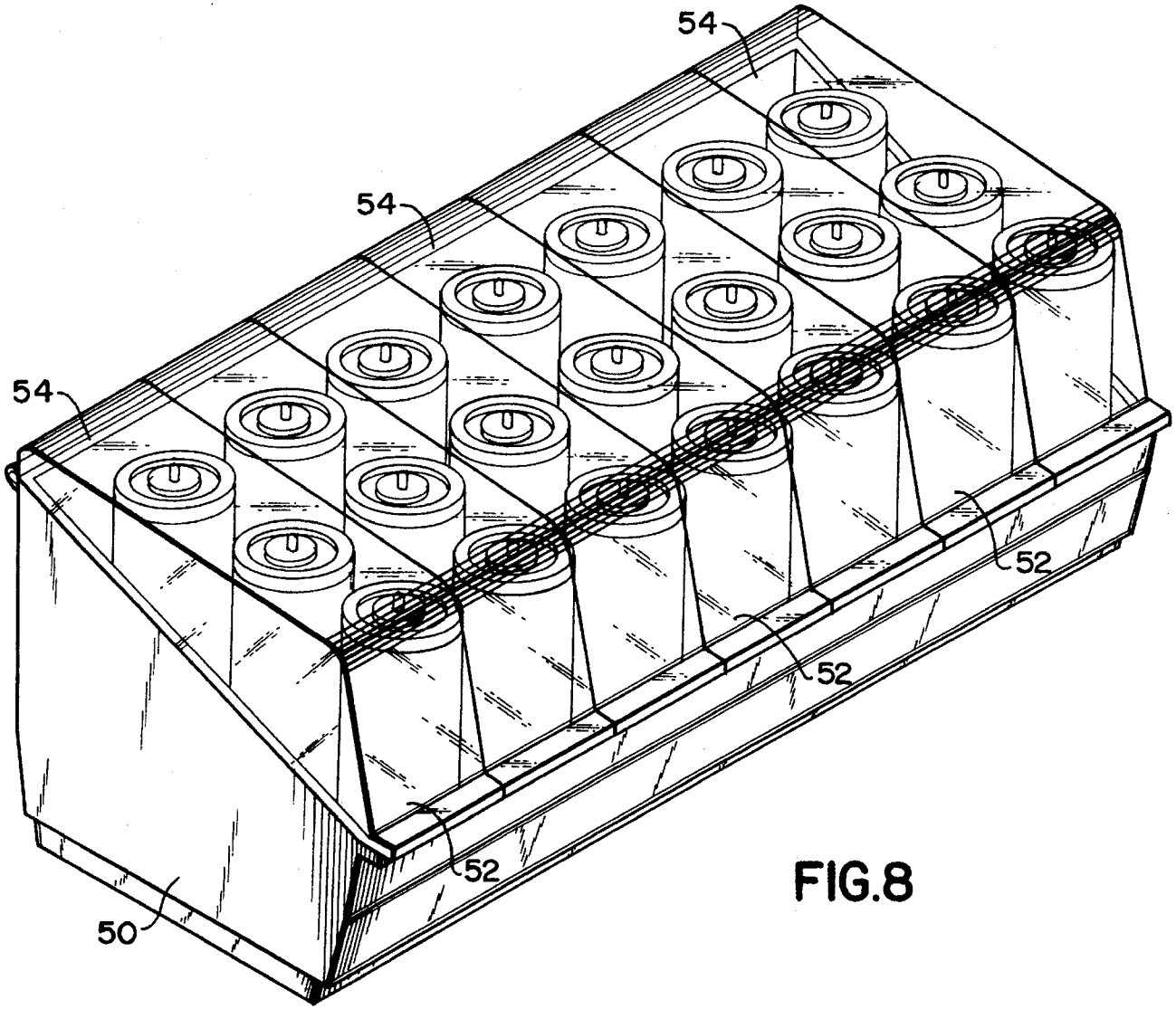
FIG. 8 is a perspective view of the receptacle or housing for a plurality of hair curler rollers as shown herein.

FIG. 7 is another embodiment of the present invention in which the hair curler roller 36 is provided with interfitting cylinders in which the inner cylinder is an insulator or heat shield 38 and is surrounded by an aluminum cylinder 40 and a plastic roller body 42, both of which are provided with perforations. The outer hair engaging sleeve 16 surrounds the entire construction. Located in the co-axial opening 44 is a pull strap 46 whereby after the hair curler roller is misted the curler can be placed upon the hair and the pull strap 46 pulled out of the opening 44 and placed over the hair strands wound about the roller sleeve whereby the loop 48 at the end of the strap 44 can be placed on the post 49 thereby entrapping the hair ends between the roller and the strap.

Figure 9:
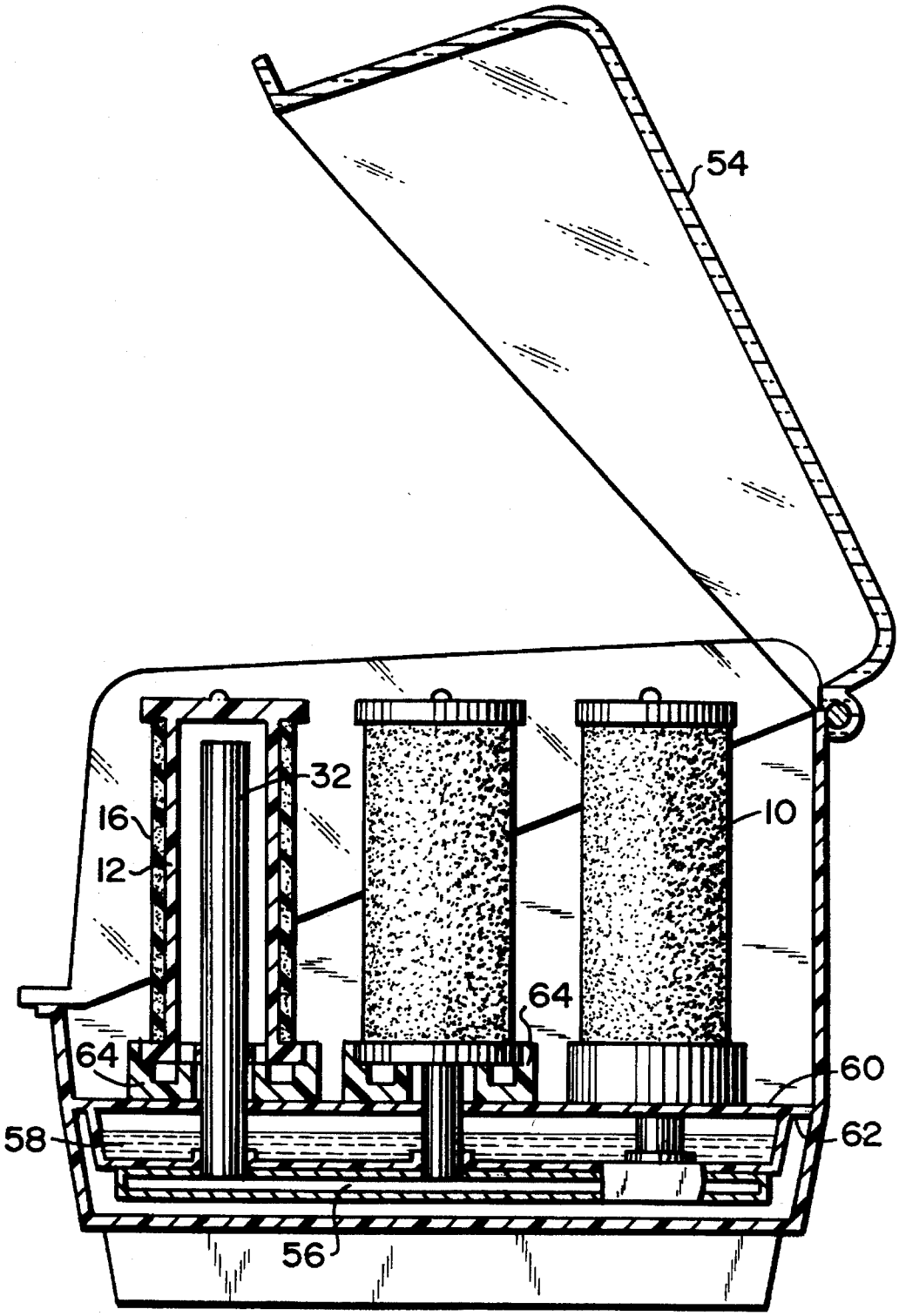
FIG. 9 is a side elevational view, partly in section, of the receptacle or housing for a plurality of hair curler rollers as shown herein.

FIGS. 8–11 shows a receptacle or housing 50 fabricated of a non-heat conductive material for a plurality of hair curler rollers each of which are mounted on end in the housing. The housing is divided into a number of separate chambers 52, each of which as shown with three hair curler rollers. The chambers 52 are each enclosed and have individual transparent lids 54, each of which can be opened individually while the rest of the chambers remain closed. As seen in FIG. 9, the apparatus for misting the rollers 10 includes a heater 56 located below a metal, heat transmitting tray 58, for example fabricated of aluminum and housing water, hair conditioner, or both. Located directly above the heated liquid tray 58 is a floor in the form of a grid 60, as clearly seen in FIG. 11. The grid 60 is provided with an external flange 62 which rests on the walls of the housing 50. Each of the hair curler rollers 10 rests on an insulating stand 64 to protect the adjacent roller end from hot mist and water boiling up from the liquid tray 58 below. The stand 64, for each of the rollers is necessary to prevent the end of the roller closest to the heat source from becoming too hot for the user of the hair curler roller to handle. It should be evident that the outer sleeves of all of the hair curlers are permeated by the vapor mist rising up from the liquid tray 58 and into each of the chambers 52. As seen in FIG. 9, the lid 54 is openable only to a selected maximum angle in order that the lid will be self closing by gravity upon the release of the particular lid by the user of the hair curler rollers.

It should be apparent that the use of a multiplicity of separate chambers or compartments 52 permits the user to select any group of three hair curlers by opening up only that chamber, thus preventing the escape of the misting vapor to the atmosphere in the other chambers. In prior art constructions, a single lid for a large number of hair curlers, when opened, allowed many of the hair curlers to cool down before all of them were used in a hair cooling procedure. The opening of two selected chambers while the others remained closed is clearly shown in FIG. 10.

As seen in FIGS. 6 and 9, dry heat may also be employed in combination with the exterior misting of the hair curler rollers. In this connection the heating post 32 is shown being thermally connected to the heater 56.

In prior art constructions, a large number of hair curlers, when opened, allowed many of the hair curlers to cool down before all of them were used in a hair cooling procedure. The opening of two selected chambers while the others remained closed is clearly shown in FIG. 11.

Figure 10:
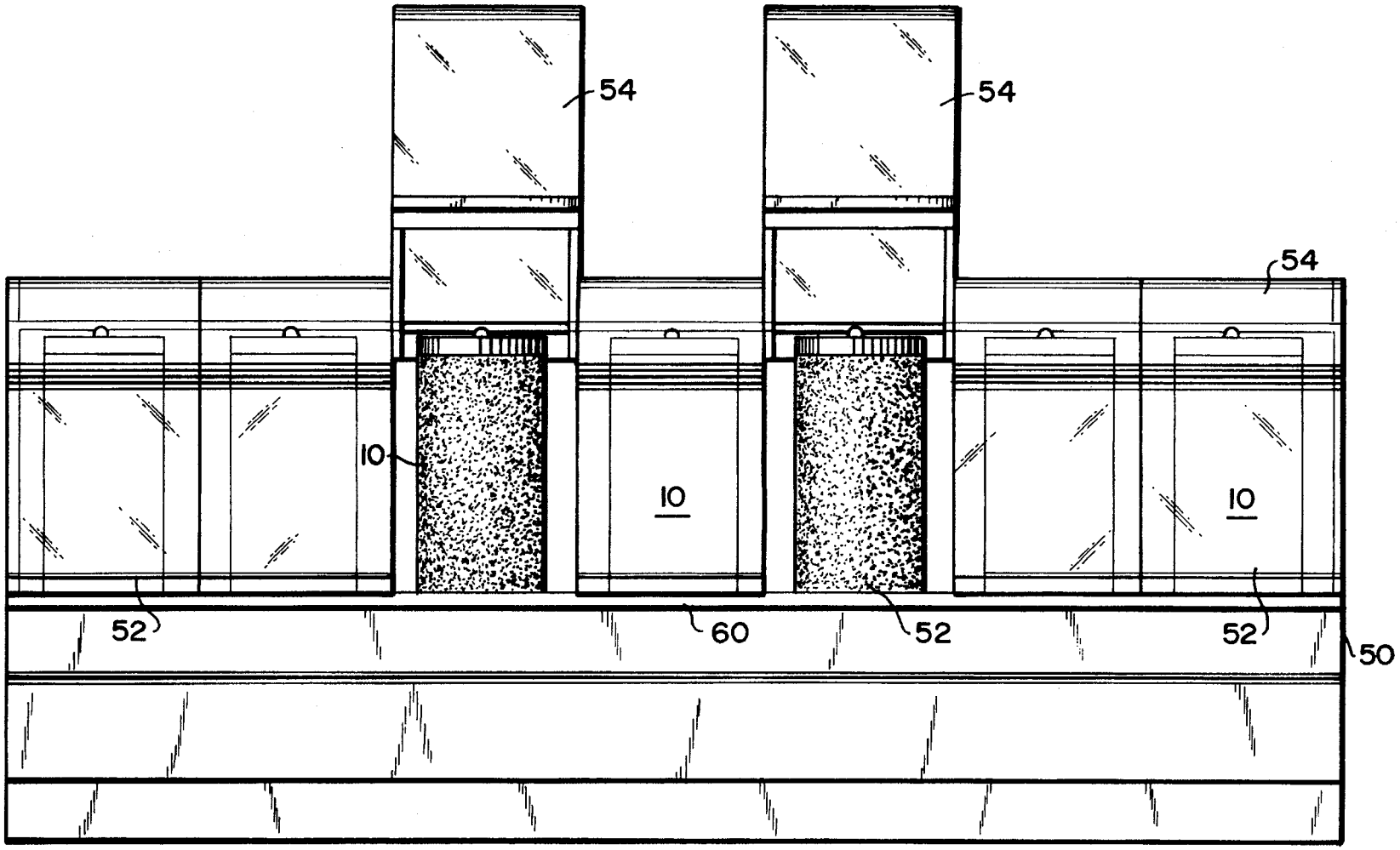
FIG. 10 is a front elevational view of the receptacle or housing shown in FIG. 8

As seen in FIG. 10, dry heat may also be employed in combination with the exterior misting of the hair curler rollers. In this connection the heating post 66 is shown being thermally connected to the heater 56.

The outer foam-like sleeve of the hair curler roller 10 is effective in capturing and retaining heat and moisture while radiating said heat and moisture into hair strands being wound around the hair curler roller. The present heated mist apparatus for misting the outer sleeves of the hair curler rollers is effective for treating hair not only with water vapor but also with hair conditioner.

While the invention has been disclosed and described with reference to certain embodiments of the invention, it will be apparent that changes and modifications may be made therein, and it is therefore intended in the following claims to cover each such variation and modification that falls within the true spirit and scope of the invention.

What I claim is:

1. A hair curler roller having a hollow cylindrical roller body, an outer foam sleeve on said roller body and provided with a front surface, said foam sleeve having an impervious inside membrane juxtaposed to said roller body, the front surface of said sleeve being foraminous so that when said roller is placed in a heated misting atmosphere the mist penetrates into said foraminous front surface and radiates throughout said sleeve while said membrane maintains the heated temperature therein for a period of time.

2. A hair curler roller as claimed in claim 1 further comprising a clasp for retaining strands of hair on the foam covering of said roller body.

3. A hair curler roller as claimed in claim 1 wherein said foam sleeve is provided with spaced holes therethrough.

4. A hair curler roller as claimed in claim 1 wherein said sleeve is a polyurethane foam.

5. A hair curler roller as claimed in claim 1 wherein said sleeve is provided with a plurality of through holes around the entire circumference of said sleeve.

6. A hair curler roller as claimed in claim 3 wherein said foam sleeve is polyurethane in which the front surface is a friction surface having a multiplicity of blind passages therein.

7. A hair curler roller as claimed in claim 1 wherein said foam sleeve is provided with die cut holes spaced about the circumference of the sleeve which passes through said front surface of said sleeve and said membrane backing of said sleeve.

8. A misting apparatus comprising a plurality of hair curler rollers wherein each of said rollers is provided with a permeable sleeve having an inner non permeable membrane and including a receptacle for holding said rollers, said receptacle being divided into a plurality of misting chambers each housing at least one of said rollers, an openable lid for each chamber, a floor supporting said rollers in said chamber having openings therethrough, and means generating steam for passage through said floor openings for misting the outside surfaces of each of the rollers.

9. A misting apparatus as claimed in claim 8 wherein said floor is a grid configuration.

10. A misting apparatus as claimed in claim 8 further comprising a heat source, a heat conducting liquid tray in contact with such heat source causes and liquid to mist and condense to a liquid, and outlet means in said floor for returning the condensed liquid from the mist in said chamber to said liquid tray.

11. A misting apparatus as claimed in claim 9 wherein each of said rollers has an end and further comprising a plurality of insulated supports for the ends of the rollers resting thereon, said supports resting on said grid.

* * * * *